US009471038B2

(12) United States Patent
Carreno et al.

(10) Patent No.: US 9,471,038 B2
(45) Date of Patent: Oct. 18, 2016

(54) DEVICE FOR DRIVING A MOBILE OF A HOROLOGICAL CALENDAR MECHANISM

(71) Applicant: ROLEX SA, Geneva (CH)

(72) Inventors: William Carreno, Geneva (CH); Frank Vernay, Farges (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/990,058

(22) Filed: Jan. 7, 2016

(65) Prior Publication Data

US 2016/0202664 A1 Jul. 14, 2016

(30) Foreign Application Priority Data

Jan. 12, 2015 (EP) ..... 15150853

(51) Int. Cl.
*G04B 19/253* (2006.01)

(52) U.S. Cl.
CPC ..... *G04B 19/25306* (2013.01)

(58) Field of Classification Search
CPC ..... G04B 19/25306; G04B 19/24326; G04B 19/24; G04B 19/253; G04B 19/25313
See application file for complete search history.

(56) References Cited

U.S. PATENT DOCUMENTS 3,827,234 A 8/1974 Imanishi
7,782,715 B2 * 8/2010 Crettex ..... G04B 19/2536 368/28
8,811,125 B2 * 8/2014 Schmidt ..... G04B 19/2536 368/28
8,830,798 B2 * 9/2014 Schmidt ..... G04B 19/253 368/37
9,081,368 B2 * 7/2015 Forsey ..... G04B 19/02
2006/0120219 A1 6/2006 Ruefenacht
2006/0221773 A1 10/2006 Kuepfer et al.
2012/0213038 A1 * 8/2012 Schmidt ..... G04B 19/2536 368/37

FOREIGN PATENT DOCUMENTS

EP 0 987 609 A1 3/2000
EP 1 666 991 A1 6/2006
WO 2004/066039 A1 8/2004

OTHER PUBLICATIONS

European Search Report and Written Opinion dated Nov. 17, 2015 issued in corresponding application No. EP15150853; w/ English partial translation and partial machine translation (13 pages).

* cited by examiner

*Primary Examiner* — Sean Kayes
(74) *Attorney, Agent, or Firm* — Westerman, Hattori, Daniels & Adrian, LLP

(57) ABSTRACT

A device for driving a date mobile (3) of a horological calendar mechanism, the device comprising:

Figure 1:
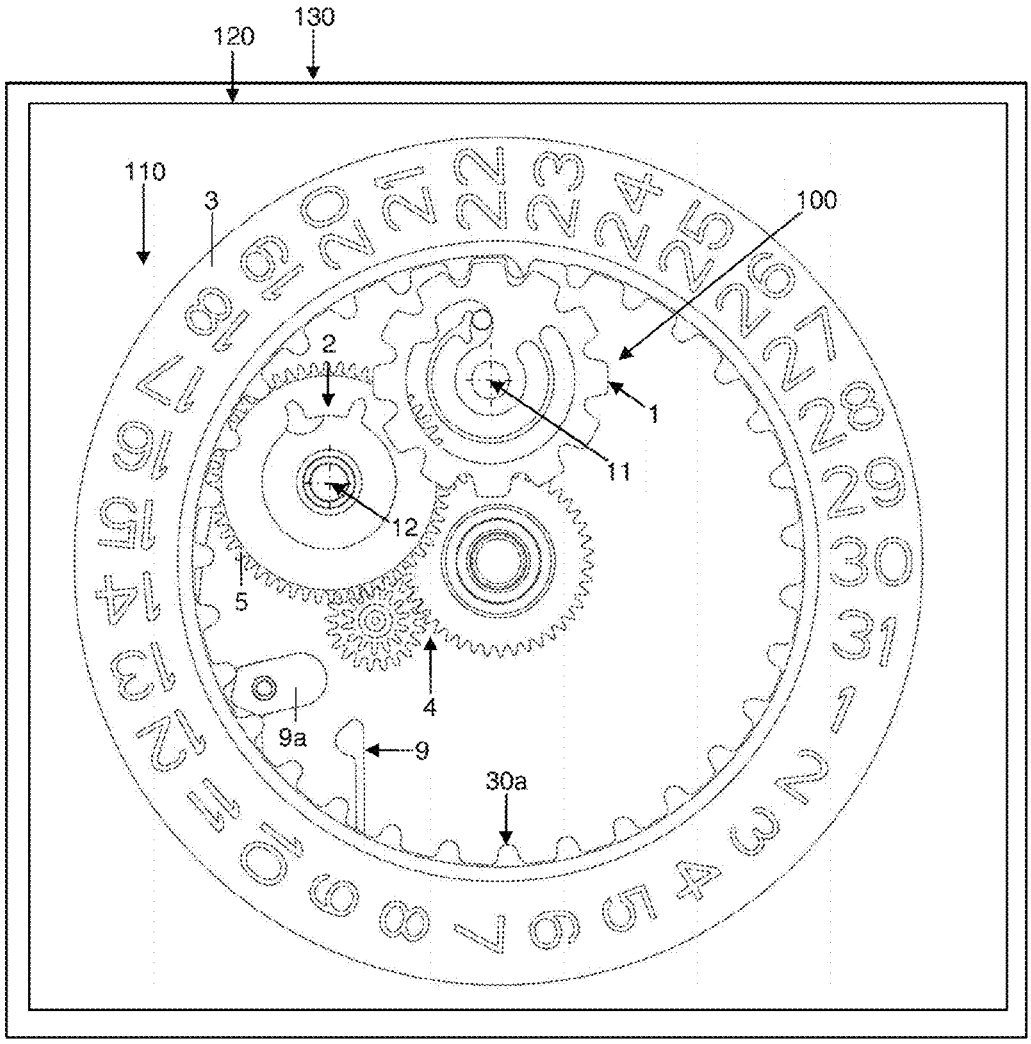

a driving mobile (2) including a first finger (20*a*) and a second finger (20*b*);

a programming mobile (1) including a first set of teeth (10*a*), a second set of teeth (10*b*) and a third set of teeth (10*c*); and the date mobile (3) including a fourth set of teeth (30*a*) and a fifth set of teeth (30*b*), the first finger cooperating with the first set of teeth, the second finger cooperating with the second set of teeth, the first set of teeth cooperating with the fourth set of teeth and the third set of teeth cooperating with the fifth set of teeth.

20 Claims, 15 Drawing Sheets

| G | M: J | F | M | A | M | J | J | A | S | O | N | D |
|---|---|---|---|---|---|---|---|---|---|---|---|---|
| 1 | 101b | 108b | 103b, 103c | 110b | 105b, 105c | 112b | 107b | 102b, 102c | 109b | 104b, 104c | 111b | 106b |
| 2 | 102b, 102c | 109b | 104b, 104c | 111b | 106b | 101b | 108b | 103b, 103c | 110b | 105b, 105c | 112b | 107b |
| 3 | 103b, 103c | 110b | 105b, 105c | 112b | 107b | 102b, 102c | 109b | 104b, 104c | 111b | 106b | 101b | 108b |
| 4 | 104b, 104c | 111b | 106b | 101b | 108b | 103b, 103c | 110b | 105b, 105c | 112b | 107b | 102b, 102c | 109b |
| 5 | 105b, 105c | 112b | 107b | 102b, 102c | 109b | 104b, 104c | 111b | 106b | 101b | 108b | 103b, 103c | 110b |
| 6 | 106b | 101b | 108b | 103b, 103c | 110b | 105b, 105c | 112b | 107b | 102b, 102c | 109b | 104b, 104c | 111b |
| 7 | 107b | 102b, 102c | 109b | 104b, 104c | 111b | 106b | 101b | 108b | 103b, 103c | 110b | 105b, 105c | 112b |
| 8 | 108b | 103b, 103c | 110b | 105b, 105c | 112b | 107b | 102b, 102c | 109b | 104b, 104c | 111b | 106b | 101b |
| 9 | 109b | 104b, 104c | 111b | 106b | 101b | 108b | 103b, 103c | 110b | 105b, 105c | 112b | 107b | 102b, 102c |
| 10 | 110b | 105b, 105c | 112b | 107b | 102b, 102c | 109b | 104b, 104c | 111b | 106b | 101b | 108b | 103b, 103c |
| 11 | 111b | 106b | 101b | 108b | 103b, 103c | 110b | 105b, 105c | 112b | 107b | 102b, 102c | 109b | 104b, 104c |
| 12 | 112b | 107b | 102b, 102c | 109b | 104b, 104c | 111b | 106b | 101b | 108b | 103b, 103c | 110b | 105b, 105c |
| 13 | 101b | 108b | 103b, 103c | 110b | 105b, 105c | 112b | 107b | 102b, 102c | 109b | 104b, 104c | 111b | 106b |
| 14 | 102b | 109b | 104b, 104c | 111b | 106b | 101b | 108b | 103b, 103c | 110b | 105b, 105c | 112b | 107b |
| 15 | 103b | 110b | 105b, 105c | 112b | 107b | 102b, 102c | 109b | 104b, 104c | 111b | 106b | 101b | 108b |
| 16 | 104b | 111b | 106b | 101b | 108b | 103b, 103c | 110b | 105b, 105c | 112b | 107b | 102b, 102c | 109b |
| 17 | 105b | 112b | 107b | 102b, 102c | 109b | 104b, 104c | 111b | 106b | 101b | 108b | 103b, 103c | 110b |
| 18 | 106b | 101b | 108b | 103b, 103c | 110b | 105b, 105c | 112b | 107b | 102b, 102c | 109b | 104b, 104c | 111b |
| 19 | 107b | 102b, 102c | 109b | 104b, 104c | 111b | 106b | 101b | 108b | 103b, 103c | 110b | 105b, 105c | 112b |
| 20 | 108b | 103b, 103c | 110b | 105b, 105c | 112b | 107b | 102b, 102c | 109b | 104b, 104c | 111b | 106b | 101b |
| 21 | 109b | 104b, 104c | 111b | 106b | 101b | 108b | 103b, 103c | 110b | 105b, 105c | 112b | 107b | 102b, 102c |
| 22 | 110b | 105b, 105c | 112b | 107b | 102b, 102c | 109b | 104b, 104c | 111b | 106b | 101b | 108b | 103b, 103c |
| 23 | 111b | 106b | 101b | 108b | 103b, 103c | 110b | 105b, 105c | 112b | 107b | 102b, 102c | 109b | 104b, 104c |
| 24 | 112b | 107b | 102b, 102c | 109b | 104b, 104c | 111b | 106b | 101b | 108b | 103b, 103c | 110b | 105b, 105c |
| 25 | 101b | 108b | 103b, 103c | 110b | 105b, 105c | 112b | 107b | 102b, 102c | 109b | 104b, 104c | 111b | 106b |
| 26 | 102b, 102c | 109b | 104b, 104c | 111b | 106b | 101b | 108b | 103b, 103c | 110b | 105b, 105c | 112b | 107b |
| 27 | 103b, 103c | 110b | 105b, 105c | 112b | 107b | 102b, 102c | 109b | 104b, 104c | 111b | 106b | 101b | 108b |
| 28 | 104b, 104c | 111b | 106b | 101b | 108b | 103b, 103c | 110b | 105b, 105c | 112b | 107b | 102b, 102c | 109b |
| 29 | 105b, 105c | 112b | 107b | 102b, 102c | 109b | 104b, 104c | 111b | 106b | 101b | 108b | 103b, 103c | 110b |
| 30 | 106b | 101b | 108b | **103b, 103c** | 110b | **105b, 105c** | 112b | 107b | **102b, 102c** | 109b | **104b, 104c** | 111b |
| 31 | 107b | 102b, 102c | 109b | 104b, 104c | 111b | 106b | 101b | 108b | 103b, 103c | 110b | 105b, 105c | 112b |

Figure 24

DEVICE FOR DRIVING A MOBILE OF A HOROLOGICAL CALENDAR MECHANISM

The invention relates to a device for driving a mobile of a calendar mechanism. It relates also to a mechanism comprising such a device. It also relates to a horological movement comprising such a device or such a mechanism. It finally relates to a timepiece, notably a wristwatch, comprising such a device, such a mechanism or such a movement.

The annual calendars known from the prior art are traditionally equipped with one or two calendar driving mobiles which are provided to cooperate with a cam or an auxiliary months wheel. This element carries the indication of the months and drives the double date jump mechanism at the end of each short month through possible additional springs and levers. Such a construction can lead to a particularly difficult sequencing of operation. While the installation of a calendar driving mobile accompanied by an energy accumulator can possibly make it possible to design a calendar with instantaneous jump for the transition from the 31-day months to the next month, the double date jump at the end of the 30-day months can be problematical, on the one hand, because of the sequencing of operation of two distinct kinematic chains driving the date indicator and, on the other hand, because of the energy increase that such a jump requires.

The patent application EP 0987609 describes an annual calendar mechanism provided with two kinematic chains driving the date indicator. A first calendar driving mobile allows, every day, a first jump of the date indicator. A second calendar driving mobile, called a correction mobile, allows for an additional jump of the date indicator at the end of a 30-day month. The latter is pivoted on a lever whose angular position is controlled by a months cam and return springs. Such a construction requires a significant number of parts, notably springs and levers, and consumes a lot of energy. Moreover, because of the sequencing of operation of such a mechanism, it is very difficult to obtain a perfectly instantaneous calendar date jump at the end of a short month.

The document U.S. Pat. No. 3,827,234 discloses an annual calendar with semi-dragging date jump, whose mechanism implements two distinct kinematic chains for driving the date indicator, that requires neither annual cam nor lever. A first conventional calendar driving mobile allows, every day, for a first jump of the date indicator. A second mobile allows for an additional jump of the date indicator at the end of a 30-day month. This mobile has teeth, the number and the arrangement of which are defined such that these teeth allow for the actuation of an additional tooth of the date indicator at the end of a short month, and thus allow, in cooperation with the conventional driving mobile, for a double jump of the date indicator. Such a mechanism presents the advantage of being simple compared to cam and lever devices, notably with respect to the mechanism disclosed in the document EP 0987609. The arrangement and the number of teeth of the second mobile make it possible in fact, with no other additional device, to distinguish short months from long months. However, the kinematic chain driving the second mobile requires an indexing device which is added to the traditional jumper of the date indicator, which is reflected in the installation of an additional spring provided to cooperate with a star which bears the teeth of the second mobile. It is therefore very difficult to achieve the implementation of an annual calendar with instantaneous date jump on the basis of such a mechanism, on the one hand because of the coordination required for a synchronized operation of the two chains driving the date indicator, and on the other hand because of the energy needed to allow for the instantaneous driving of two distinct driving mobiles, each mobile requiring indeed an energy accumulator that is dedicated to it.

The patent application EP 1666991 discloses an annual calendar mechanism with dragging date jump, which is provided with just one calendar driving mobile. The latter bears two driving fingers. The first finger allows, every day, for a first jump of the date indicator. The second finger is provided to drive the date indicator by an additional pitch, notably through a months mobile placed at the center of the movement. This mobile consists of two wheels fixed to one another. At the end of a thirty-day month, from the thirtieth to the "thirty-first", the months mobile is driven by a first angular pitch through an additional tooth borne by the date indicator which is itself actuated by the first finger of the calendar driving mobile. From the "thirty-first" to the first of the next month, the months mobile is actuated by a second angular pitch by the second finger of the calendar mobile, and consequently drives the date indicator by an additional pitch through the additional tooth of the date indicator. Such sequencing is made possible by the fact that the calendar is purely dragging. The synchronized driving of each of the elements, notably of the date indicator and of the months mobile, would in effect lead to the immobilization of the device. Thus, it is not possible to achieve the implementation of an annual calendar with instantaneous date jump on the basis of such a mechanism.

The aim of the invention is to provide a device for driving a calendar mobile or a calendar organ that makes it possible to remedy the abovementioned drawbacks and improve the driving devices known from the prior art. In particular, the invention proposes a simple, compact, reliable and robust driving device, notably for the implementation of an annual calendar with instantaneous date jump.

A driving device according to the invention is defined as a device for driving a date mobile of a horological calendar mechanism, notably for driving a date disk of a horological calendar mechanism, the device comprising:

- a driving mobile including a first finger and a second finger;
- a programming mobile including a first set of teeth, a second set of teeth and a third set of teeth; and
- the date mobile including a fourth set of teeth and a fifth set of teeth, the first finger cooperating with the first set of teeth, the second finger cooperating with the second set of teeth, the first set of teeth cooperating with the fourth set of teeth and the third set of teeth cooperating with the fifth set of teeth.

Different embodiments of the driving device are defined as follows:

- the device as above, wherein the programming mobile comprises a first wheel and a second wheel, the first set of teeth being located on the first wheel and the second and third sets of teeth being located on the second wheel;
- the device as above, wherein the first and second wheels can be displaced, notably rotationally displaced, relative to one another, and wherein the programming mobile comprises a return element, such as a spring, returning the first and second wheels to a first predefined relative position;
- the device as above, wherein the programming mobile comprises a first abutment, notably a wall of an opening, and comprises a second abutment, notably a pin, the first and second abutments being located respectively on the first and second wheels or being located respectively on the second and first wheels;

the device as above, wherein the programming mobile comprises a third abutment, notably a wall of an opening formed on one or the other of the first and second wheels, and comprises a fourth abutment, notably a surface of the return element, in particular a surface of an end of the return element, the third and fourth abutments being located respectively on the first and second wheels or being located respectively on the second and first wheels;

the device as above, wherein the first and second wheels are arranged so as to be able to be displaced relative to one another by a value of the order of the angular pitch of the first and second wheels, in particular by 30°;

the device as above, wherein the device comprises a jumper, notably a jumper head, cooperating with the fourth set of teeth or with the first set of teeth;

the device as above, wherein the jumper and the return element are arranged such that the resisting torque opposing the rotation of the first wheel and exerted by the jumper is greater than the resisting torque opposing the rotation of the second wheel and exerted by the return element;

the device as above, wherein the first set of teeth has a number of teeth which is a multiple of twelve and/or wherein the second set of teeth has a number of teeth which is a multiple of twelve and/or wherein the third set of teeth has a number of teeth which is a multiple of four and/or wherein the fourth set of teeth has thirty-one teeth and/or wherein the fifth set of teeth has one tooth;

the device as above, wherein the first set of teeth has twelve teeth and/or wherein the second set of teeth has twelve teeth and/or wherein the third set of teeth has four teeth, the teeth of the third set of teeth having an angular pitch of 30° and being juxtaposed at the level of four consecutive 30° angular segments and/or wherein the fourth set of teeth has thirty-one teeth and/or wherein the fifth set of teeth has one tooth;

the device as above, wherein the first finger, the first set of teeth and the fourth set of teeth are disposed on a first level, notably at the level of a first plane and/or wherein the second finger and the second set of teeth are disposed on a second level, notably at the level of a second plane, and/or wherein the third set of teeth and the fifth set of teeth are disposed on a third level, notably at the level of a third plane;

the device as above, wherein teeth of the second set of teeth and teeth of the third set of teeth are formed by common surfaces of the second wheel, notably common surfaces extending parallel to the axis of rotation of the programming mobile.

A mechanism according to the invention is defined as a calendar mechanism comprising a device as above.

An embodiment of the mechanism is defined as of the instantaneous jump type.

A movement according to the invention is defined as comprising a device as above or a mechanism as above.

A timepiece according to the invention is defined as a timepiece, in particular a wristwatch, comprising a device as above or a mechanism as above or a movement as above.

FIGS. 1 to 24 represent, by way of example, an embodiment of a timepiece according to the invention.

An embodiment of a timepiece 130 is described hereafter with reference to FIGS. 1 to 24. The timepiece is, for example, a wristwatch. The timepiece comprises an embodiment of a horological movement 120 according to the invention, notably a mechanical horological movement. The movement includes an embodiment of a calendar mechanism 110 according to the invention, notably an annual calendar mechanism, in particular an annual calendar mechanism of the type with instantaneous jump. "Calendar mechanism with instantaneous jump" should be understood to mean a calendar mechanism in which the transitional phase between two consecutive date displays typically lasts less than a tenth of a second, in normal operation. The calendar mechanism comprises, for example, one or more date indication mobiles, for example a disk 3 having inscriptions representative of the dates 1 to 31 or a hand that moves to come into line with date indications or two disks, a first disk having inscriptions representative of the tens digits of the date and a second disk having inscriptions representative of the units digits of the date. Advantageously, the annual calendar mechanism can further comprise month indication elements. The annual calendar mechanism typically requires only one correction per year, typically a correction at the end of the month of February.

The calendar mechanism 110 comprises an embodiment of a driving device 100 according to the invention.

The embodiment of the driving device 100 is described in more detail hereafter with reference to FIGS. 1 to 9. The device makes it possible to drive the mobile 3 of the horological calendar mechanism 110, notably the disk 3 showing date indications. For example, this disk is intended to cooperate with an aperture to produce a display of the current date in this aperture.

The driving device mainly comprises:

a driving mobile 2 including a first finger 20*a* and a second finger 20*b;* a programming mobile 1 or programming mechanism 1 including a first set of teeth 10*a*, a second set of teeth 10*b* and a third set of teeth 10*c*; and the date indication mobile 3 including a fourth set of teeth 30*a* and a fifth set of teeth 30*b*.

The first finger is suitable for cooperating with the first set of teeth, the second finger is suitable for cooperating with the second set of teeth, the first set of teeth is suitable for cooperating with the fourth set of teeth and the third set of teeth is suitable for cooperating with the fifth set of teeth.

Thus, the first finger is suitable for actuating the first set of teeth, notably by gear-meshing, the second finger is suitable for actuating the second set of teeth, notably by gear-meshing, the first set of teeth is suitable for actuating the fourth set of teeth, notably by gear-meshing, and the third set of teeth is suitable for actuating the fifth set of teeth, notably by gear-meshing.

Thus, it is possible to obtain a particularly simple driving device intended to drive the date indicator or date mobile. The simplicity of the architecture adds reliability and robustness to the device. This reliability and this robustness can be exploited to produce a calendar mechanism of the type with instantaneous jump.

Advantageously, the second and third sets of teeth are distinct, that is to say that the teeth of the second set of teeth cooperate neither with the fourth set of teeth nor with the fifth set of teeth and the teeth of the third set of teeth cooperate with the fifth set of teeth without cooperating with the fourth set of teeth.

Advantageously, the first finger 20*a* and the second finger 20*b* of the driving mobile 2 cannot be displaced relative to one another. Advantageously, the fourth set of teeth 30*a* and the fifth set of teeth 30*b* of the date indicator cannot be displaced relative to one another.

The programming mobile 1 has the particular feature of being disposed at the interface of the calendar driving mobile 2 and of the date indicator or date disk 3. The programming mobile makes it possible to recognize and distinguish the short months from the long months.

Figure 9:
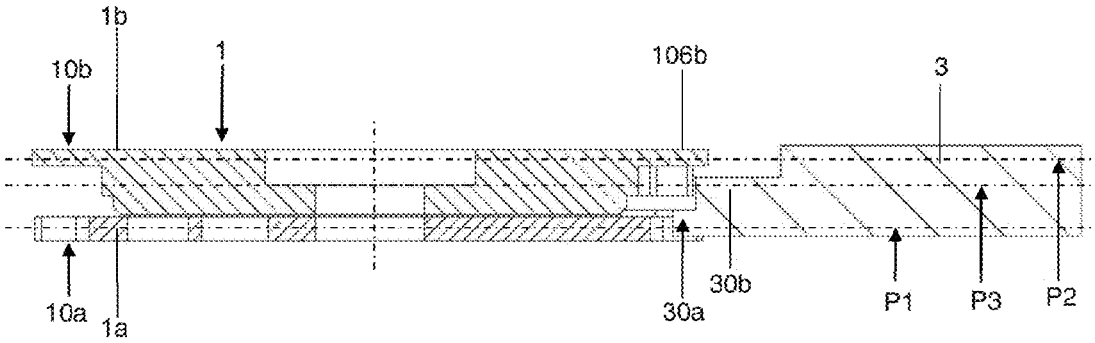

Advantageously, the first finger 20*a*, the first set of teeth 10*a* and the fourth set of teeth 30*a* are disposed on a first level, notably are disposed at the level of a first plane P1 as represented partially in FIG. 9. Complementing this, the second finger 20*b* and the second set of teeth 10*b* can be disposed on a second level, notably be disposed at the level of a second plane P2. Again complementing this, the third set of teeth 10*c* and the fifth set of teeth 30*b* can be disposed on a third level, notably be disposed at the level of a third plane P3. These planes P1 and/or P2 and/or P3 are for example at right angles to the axes of rotation 11 and 12 of the programming mobile and of the driving mobile.

Figure 2:
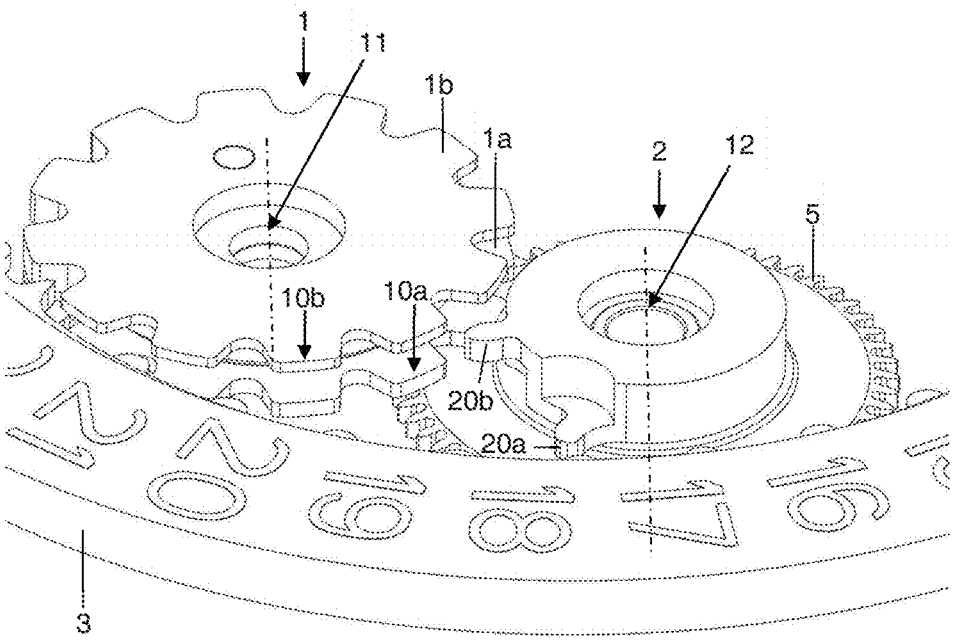
Figure 3:
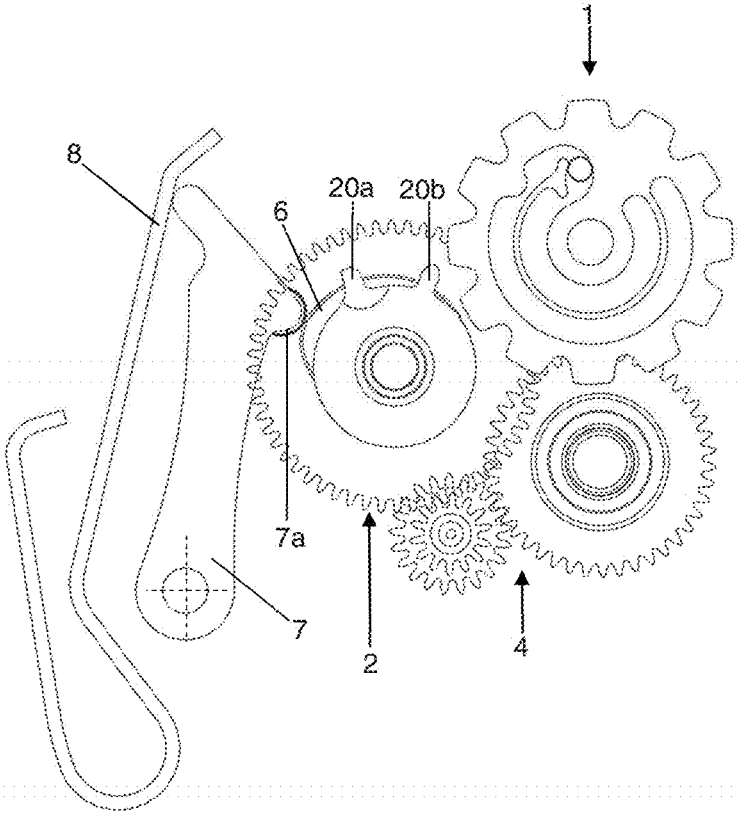
Figure 4:
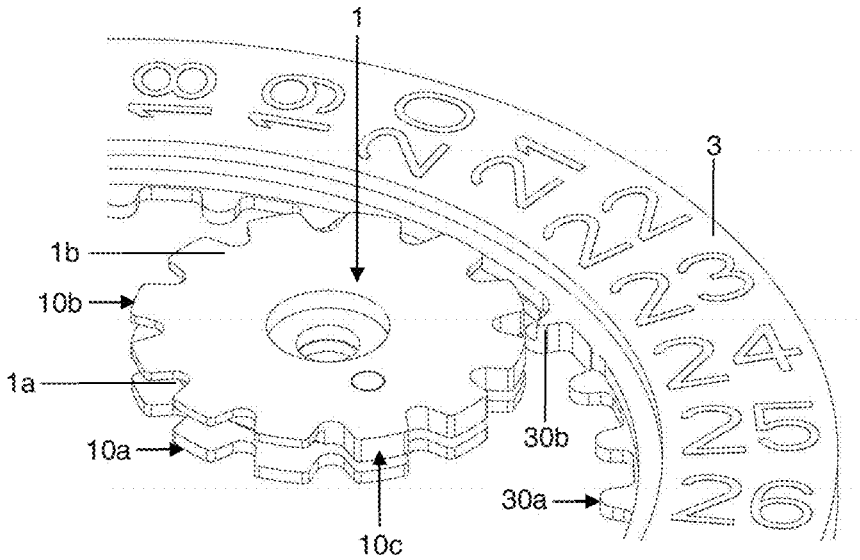
Figure 6:
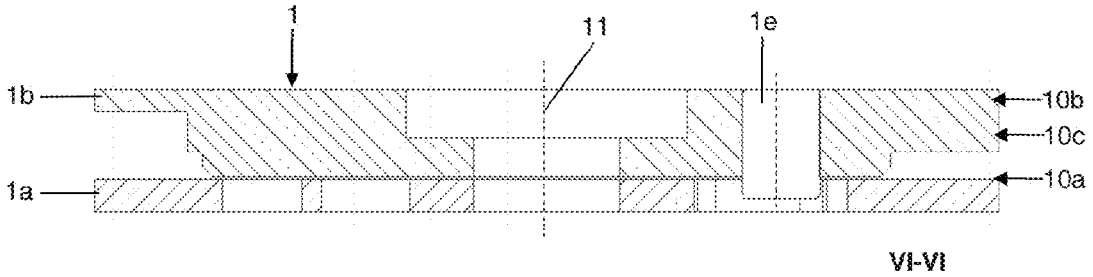

As represented in particular in FIGS. 2, 4 and 6, the programming mobile 1 comprises a first wheel 1*a* and a second wheel 1*b*. These two wheels are for example superposed. The first set of teeth is located on the first wheel and the second and third sets of teeth are located on the second wheel. The two wheels are advantageously linked in rotation by a link 1*c*, 1*d*, 1*e*, 1*f*, 1*g*, 1*h*, 1*i* allowing a relative movement of the first and second wheels, that is to say that the first and second wheels can be displaced, notably rotationally displaced relative to one another. The first and second wheels can be pivoted one on the other at the level of their axes. The first and second wheels can be arranged so as to be able to be displaced relative to one another by a value of the order of the angular pitch of the first and second wheels, in particular 30°. This link can be likened to a clutch at least in certain phases of operation of the device.

Figure 5:
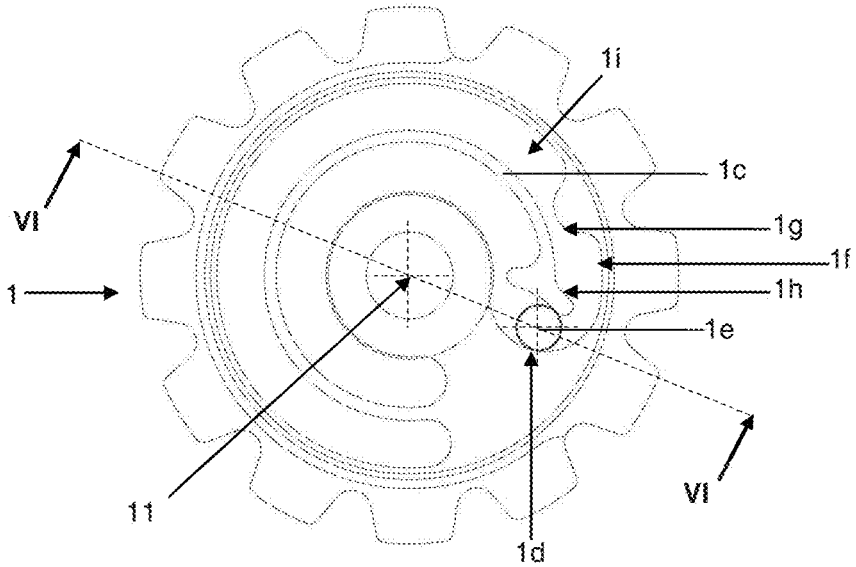

Advantageously, as represented by FIG. 5, the programming mobile comprises a return element 1*c*, such as a spring 1*c*, returning the first and second wheels to a first predefined relative position, i.e. a rest or return position.

Furthermore, the programming mobile can comprise a first abutment 1*d*, notably consisting of a portion of wall 1*d* of an opening 1*i* formed for example on the wheel 1*a*, and a second abutment 1*e*, notably a pin 1*e*. These first and second abutments cooperate to define, when they are in contact with one another, the predefined first position of the wheel 1*a* relative to the wheel 1*b*. The first and second abutments can be located respectively on the first and second wheels 1*a*, 1*b* or be located respectively on the second and first wheels 1*a*, 1*b*.

The spring 1*c* and the abutment 1*d* can be produced in one piece with the plate of the first wheel 1*a*. The pin 1*e* can be driven onto the plate of the second wheel 1*b*. The second wheel 1*b* can thus be angularly indexed relative to the first wheel 1*a* through the pin 1*e* which is pressed against the abutment 1*d* under the effect of the spring 1*c*.

The programming mobile 1 can comprise a third abutment 1*g*, notably a wall 1*g* of an opening, or of the abovementioned opening 1*i*, and a fourth abutment 1*h*, notably a surface 1*h* of the return element 1*c*, in particular a surface 1*h* of an end of the return element 1*c*. The third and fourth abutments can be located respectively on the first and second wheels 1*a*, 1*b* or be located respectively on the second and first wheels 1*a*, 1*b*.

The first and second wheels 1*a* and 1*b* of the driving mobile are both provided to be actuated, every day, by the calendar driving mobile 2. To this end, the driving mobile is provided, as seen previously, with two driving fingers 20*a* and 20*b*. These fingers are advantageously superposed or situated on two levels relative to the axis of rotation 12 of the driving mobile. These first and second fingers are each dedicated to driving the first and second sets of teeth 10*a*, 10*b* of the wheels 1*a*, 1*b*. Thus, preferentially, the first driving finger 20*a* can be disposed on the first level P1, and the second driving finger 20*b* can be disposed on the second level P2. The driving mobile also comprises a calendar wheel 5, performing one full rotation in 24 hours. This wheel 5 is linked to a drive-train 4 of the basic movement of the timepiece. The driving mobile 2 also comprises a cam 6 which is provided to cooperate with an energy accumulator, so that the driving fingers 20*a* and 20*b* can instantaneously drive the programming mobile 1 at the moment of midnight, that is to say that the first and second fingers arrive in a position of start of meshing with the sets of teeth of the wheels of the programming mobile, mesh with these sets of teeth, then leave a position of end of meshing with these sets of teeth, within a period typically less than a tenth of a second.

The cam 6 can be fixed to the first and second driving fingers 20*a*, 20*b*. A clutch between the calendar wheel 5 and the cam 6 (not represented) can be implemented through conventional means, such as, for example, an oblong cutout shaped to cooperate with a pin, or through a detent device such as that disclosed in the patent application EP 2428855A1, in particular in the passage of paragraphs 16 to 21.

The energy accumulator can comprise a lever 7 provided with a runner 7*a* which is pressed against the side of the cam 6 by a spring 8.

The programming mobile 1 is continually engaged with the date disk 3. Thus, an actuation of the driving mobile, notably an actuation of the driving mobile over one revolution, induces the rotation of the date disk 3, in particular over at least one angular pitch.

More particularly, the first set of teeth 10*a* of the first wheel 1*a* is continually engaged with the fourth set of teeth 30*a* of the date disk 3. This fourth set of teeth can be angularly indexed relative to the frame of the movement through a nose 9*a* of a jumper 9, as represented in FIG. 1. Thus, the programming mobile 1 is also angularly positioned, indirectly, by the nose 9*a* of the jumper 9 to within the play of the set of teeth. Alternatively, the jumper can cooperate directly with the first set of teeth 1*a* of the first wheel. In this case, it is the disk 3 which is also positioned angularly, indirectly, by the jumper. The jumper 9 can cooperate with the fourth set of teeth 30*a* or with the first set of teeth 10*a*.

Advantageously, the jumper and the return element are shaped and arranged such that the resisting torque opposing the rotation of the first wheel and exerted by the jumper is greater than the resisting torque opposing the rotation of the second wheel and exerted by the return element, these torques being expressed about the same axis, notably about the axis 11 of rotation of the programming mobile.

In addition to the 31 teeth of the fourth set of teeth 30*a*, the date mobile is also provided with a fifth set of teeth 30*b*. This fifth set of teeth can notably comprise a single tooth. This fifth set of teeth can be superposed on the fourth set of teeth 30*a* as represented in FIG. 4. These fourth and fifth sets of teeth are for example superposed. These fourth and fifth sets of teeth are advantageously superposed or situated on two levels relative to the axis of rotation of the date mobile.

The tooth of the fifth set of teeth 30*b* is likely to be actuated by the third set of teeth 10*c*, on the 30th of a short month (that is to say of a 30-day month). Thus, the date disk 3 can be driven over two angular pitches.

In the embodiment described, the first set of teeth 10*a* of the first wheel 1*a* comprises twelve teeth which are all identical. The second set of teeth 10*b* of the second wheel 1*b* also comprises twelve teeth. The third set of teeth comprises four teeth which are arranged to actuate the date disk. These four teeth correspond to the four short months of the year, except for the month of February. These are distributed within the second set of teeth 10*b* such that one or other of these teeth is likely to be facing the tooth 30*b* on the 30th of a short month. The distribution of these teeth is explained later.

In the embodiment described, the teeth of the second set of teeth 10*b* and the teeth of the third set of teeth 10*c* are formed by common surfaces formed on a same part, notably common surfaces extending parallel to the axis of rotation of the programming mobile. Alternatively, the surfaces forming the teeth of the second and third sets of teeth can be discontinuous, that is to say that there can be a discontinuity between the second and third sets of teeth. The surfaces of the second and third sets of teeth can be formed simultaneously, for example by machining, cutting or forming. Alternatively, the second set of teeth can be formed on a first part and the third set of teeth can be formed on a second part. The first and second parts can then be assembled or fixed to one another to form the second wheel.

In another embodiment not represented, the first set of teeth can have a number of teeth which is a multiple of twelve, for example 24 or 36 teeth, and/or the second set of teeth can have a number of teeth which is a multiple of twelve, for example 24 or 36 teeth, and/or the third set of teeth can have a number of teeth which is a multiple of four, for example 8 or 12 teeth, and/or the fourth set of teeth can have thirty-one teeth and/or the fifth set of teeth can have one tooth.

The operation of the driving device is described in detail below.

A conventional date jump at the end of a 31-day month, for example at the end of the month of January, is described. The operation is the same on the other days of the month, except for the transition from the 30th of a short month to the first of the next month. Figure illustrates the annual calendar mechanism on January 30, just before the date jump from January 30 to 31.

Figure 7:
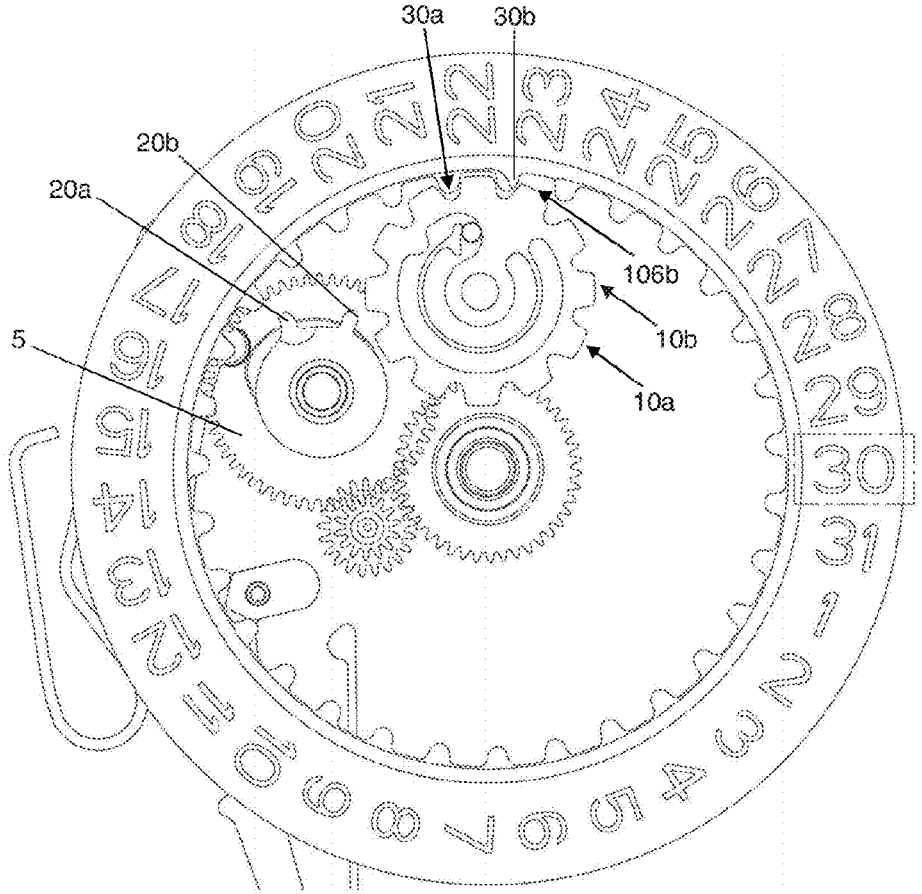

Throughout the day, the wheel 5 drives the cam 6 and accumulates the energy needed for the instantaneous jump of the fingers 20*a* and 20*b* by arming the spring 8 via the profile of the cam 6 and of the lever 7. Just before the date transition, the runner 7*a* arrives at the summit of the profile of the cam 6. FIG. 7 illustrates the mechanism in such a configuration. It will be noted that the teeth 20*a*, 20*b* are out of range of the teeth 10*a*, 10*b*.

Figure 8:
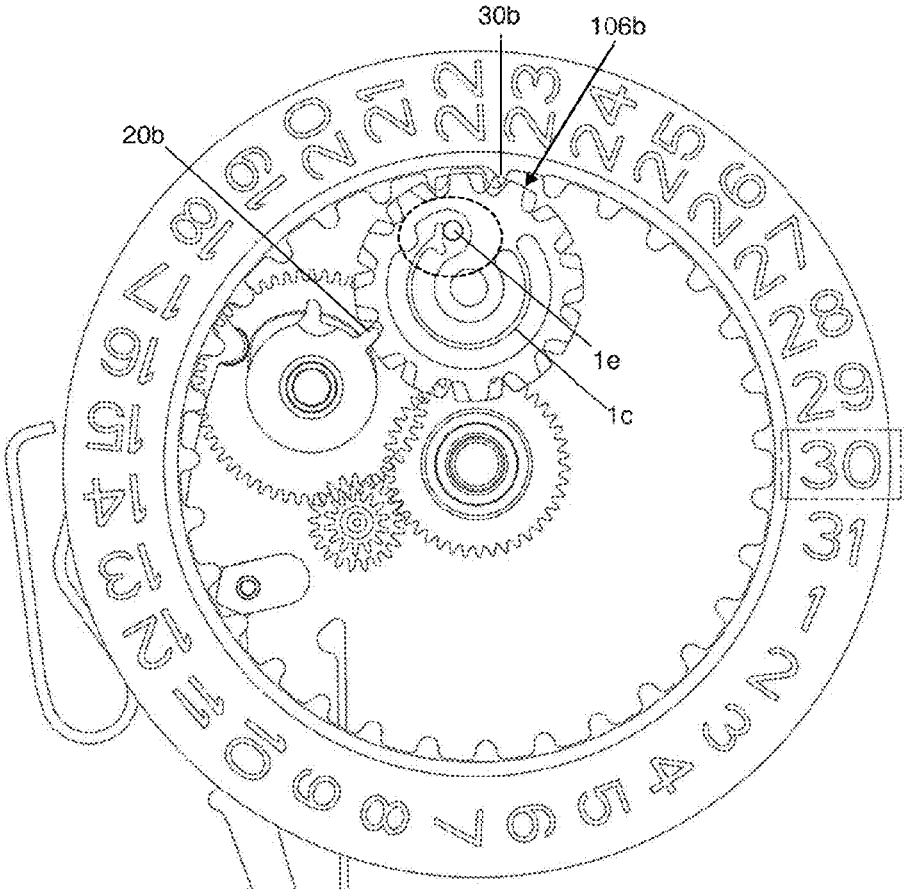
Figure 10:
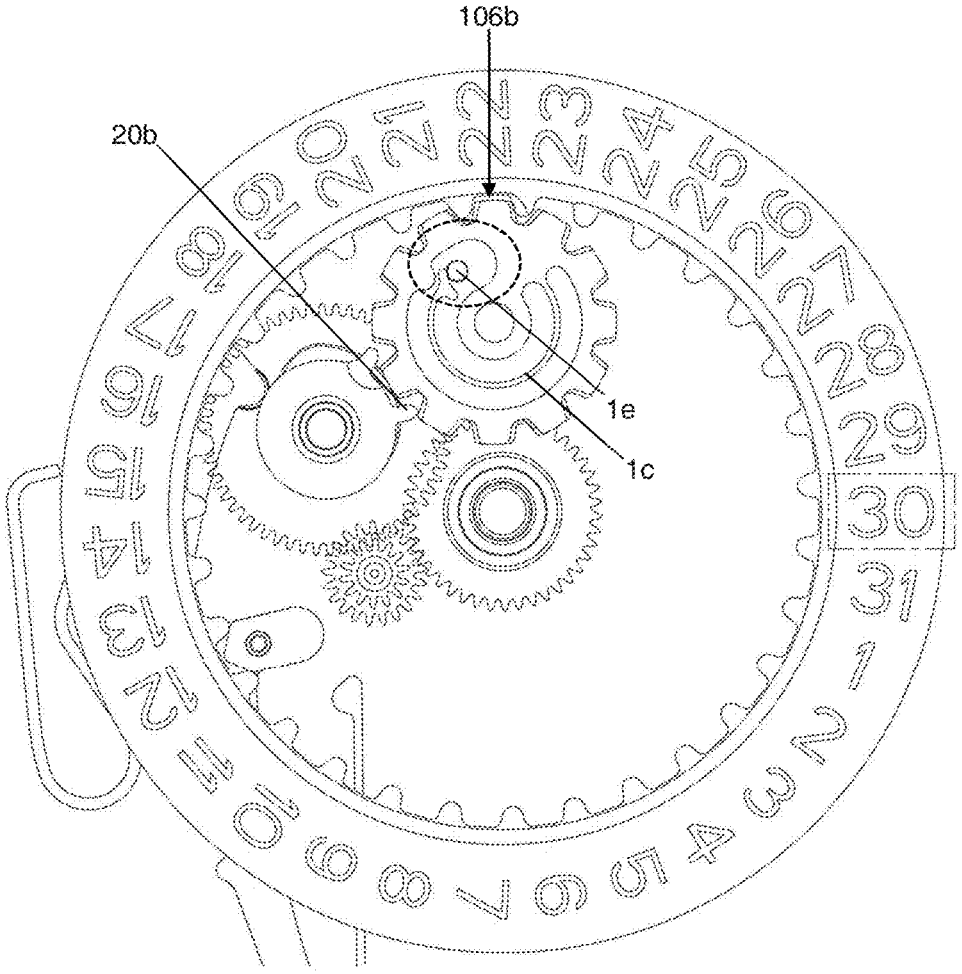

FIGS. 8 to 12 illustrate the device during the date jump from January 30 to 31. Initially, the tooth 20*b* of the driving mobile 2 comes to actuate one of the teeth of the set of teeth 10*b* of the wheel 1*b* as illustrated in FIGS. 8 to 10, which induces a relative displacement between the wheel 1*b* and the wheel 1*a* by the deformation of the spring 1*c* under the effect of the displacement of the pin 1*e*. This is made possible by the fact that the return torque produced by the spring 1*c* is substantially less than the return torque produced by the jumper 9 of the date disk. The rotation of the wheel 1 here has no effect on the date disk because the tooth 106*b* which is situated facing the tooth 30*b* of the date disk is shaped so as not to actuate the tooth 30*b*. More particularly, the thickness of the tooth 106*b* is defined such that this tooth can pass over the tooth 30*b* as represented in FIG. 9. In other words, in this configuration, there is no tooth of the third set of teeth which can come to cooperate with the tooth 30*b* of the fifth set of teeth.

The wheel 1*b* continues to pivot while the finger 20*b* drives the set of teeth 10*b*. FIG. 10 represents the finger 20*b* at the end of driving. The spring 1*c* is ready to restore the accumulated energy so as to re-index the wheel 1*b* relative to the wheel 1*a*, i.e., to return the first and second wheels to their relative rest position, at the instant, or substantially at the instant, when the finger 20*a* comes to actuate one of the teeth of the set of teeth 10*a* of the wheel 1*a* as represented in FIG. 11.

Figure 11:
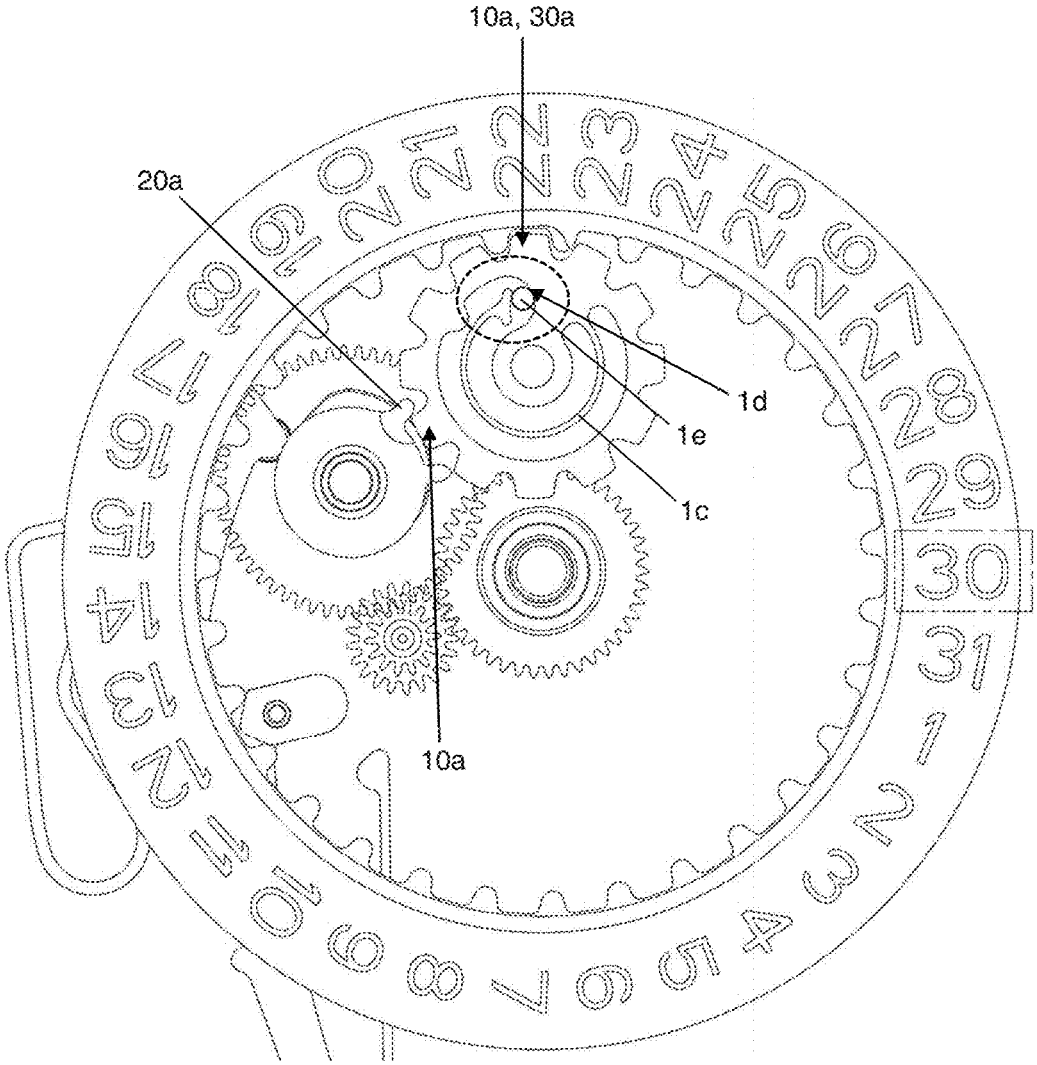
Figure 12:
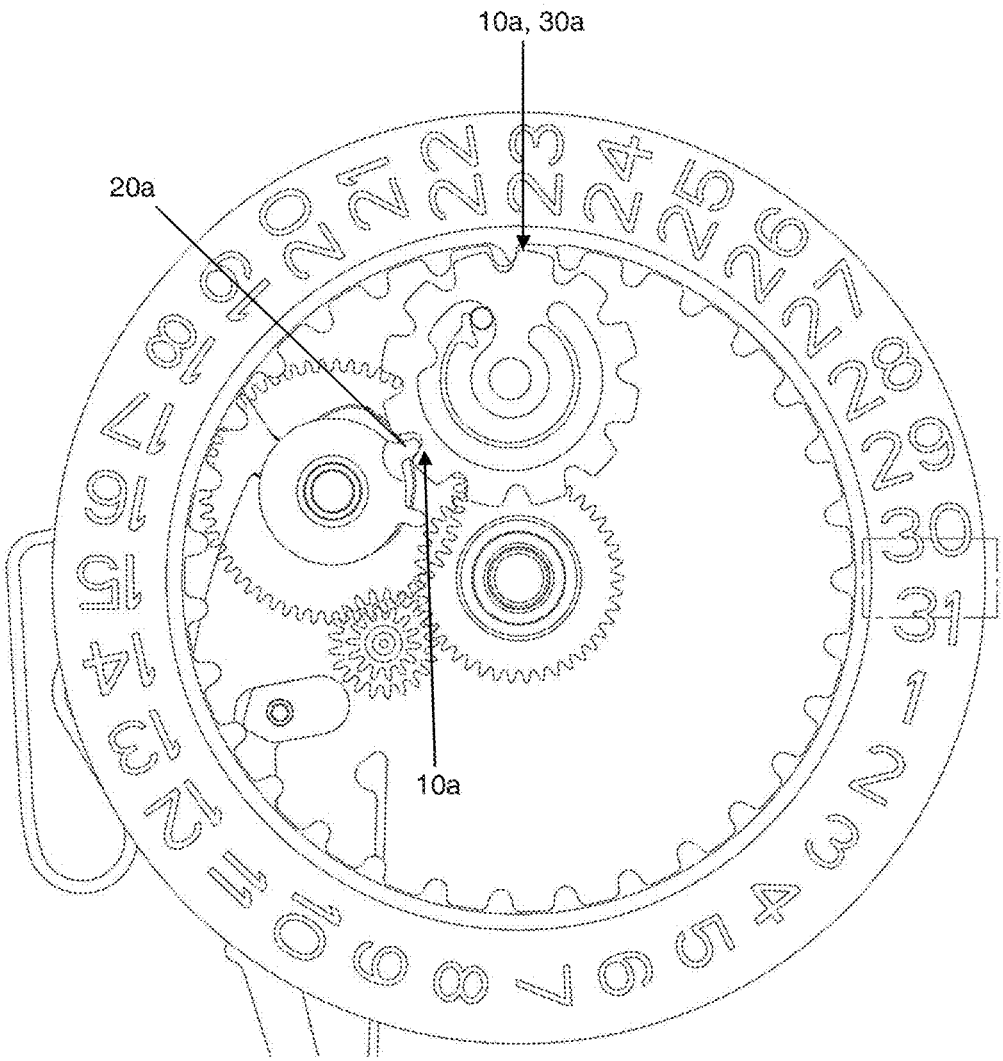
Figure 13:
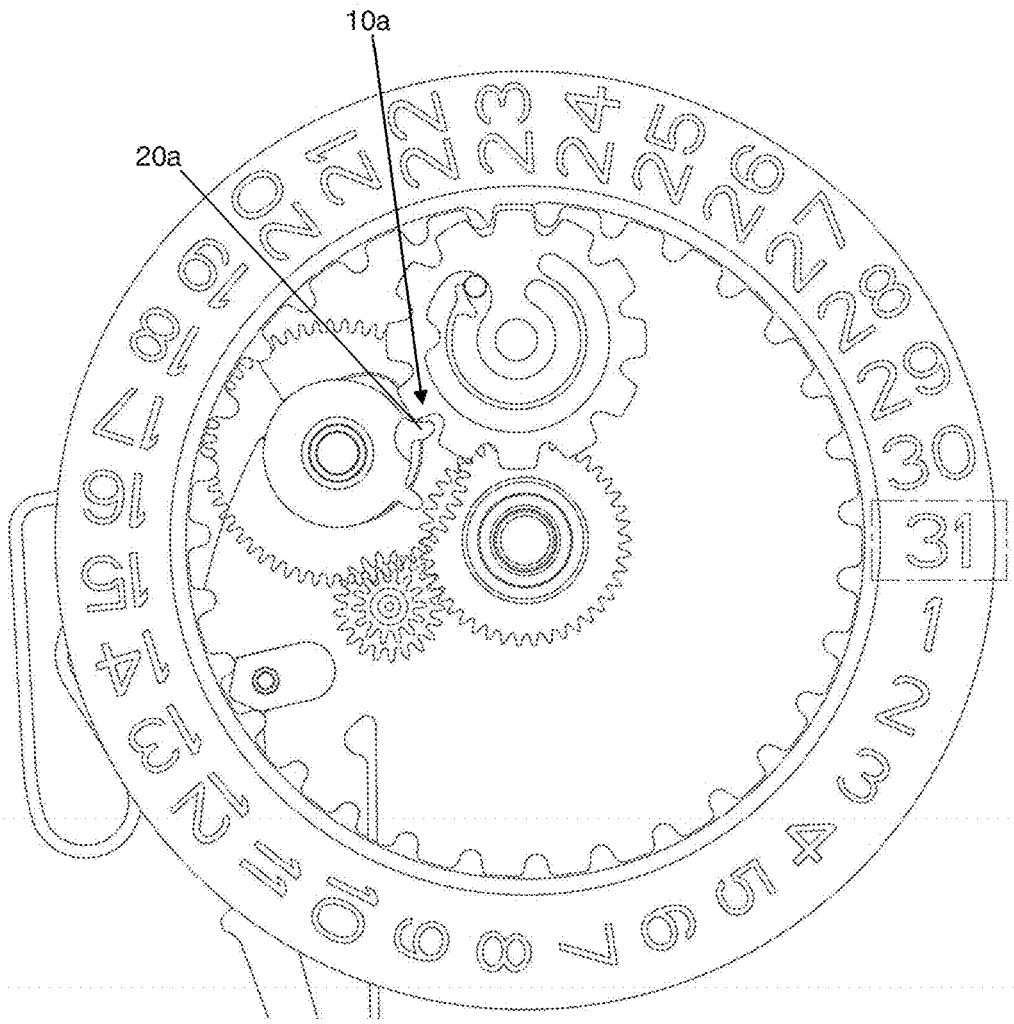

FIG. 11 represents the tooth 20*a* of the driving mobile 2 at the instant when the latter comes to actuate one of the teeth of the set of teeth 10*a* of the wheel 1*a*, which induces the rotation of the wheel 1*a* and of the wheel 1*b*, the two wheels being secured in rotation under the effect of the means 1*c*, 1*d*, 1*e*. The rotation of the wheel 1*a* provokes the jump of the disk 3 over an angular pitch of the date disk, given that the set of teeth 10*a* is continually engaged with the set of teeth 30*a* of the date disk as illustrated by FIG. 9. FIGS. 11 to 13 represent such a jump of the date disk. Once the jump has been completed as represented in FIG. 13, the finger 20*a*, held in position under the effect of the immobilization of the cam 6, is situated in the set of teeth 10*a* so as to avoid any risk of additional jump of the date disk.

Thus, the conventional date jump is produced by the rotation by one angular pitch of the wheel 1*a*, which also involves the rotation by one angular pitch of the wheel 1*b*. Thus, every day at midnight, the mobile 1 turns by at least one angular pitch.

Figure 14:
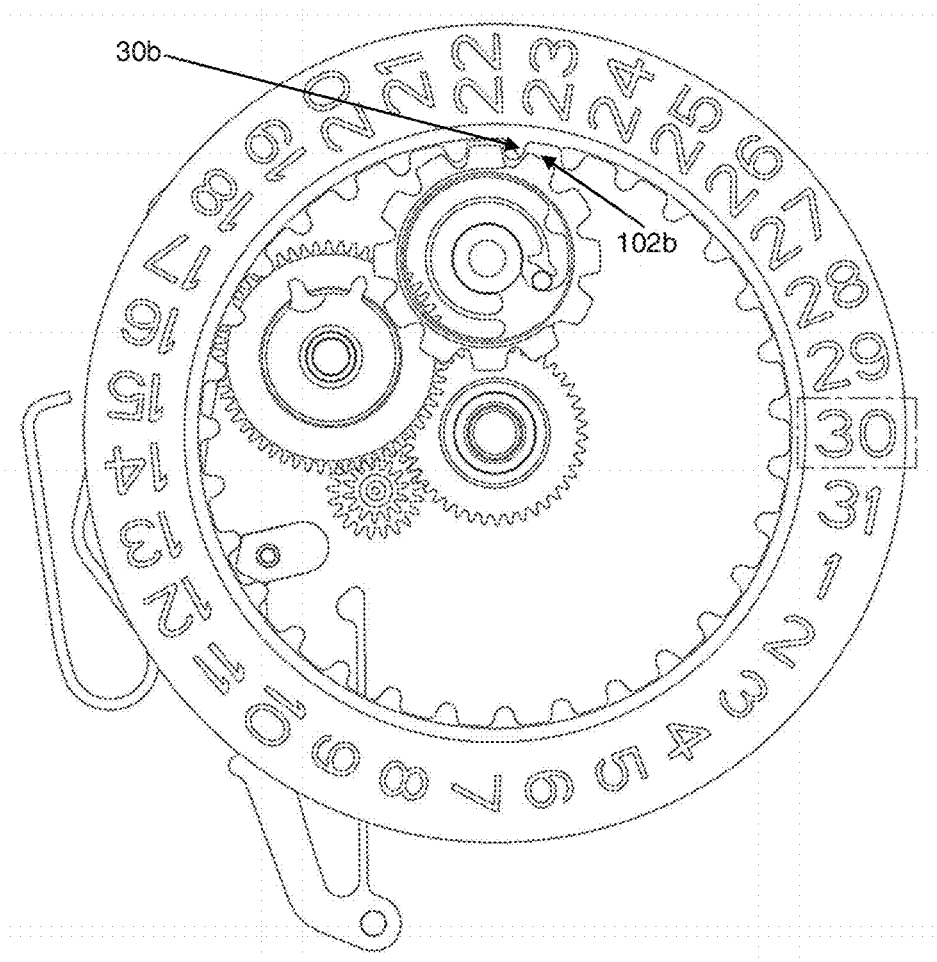
Figure 15:
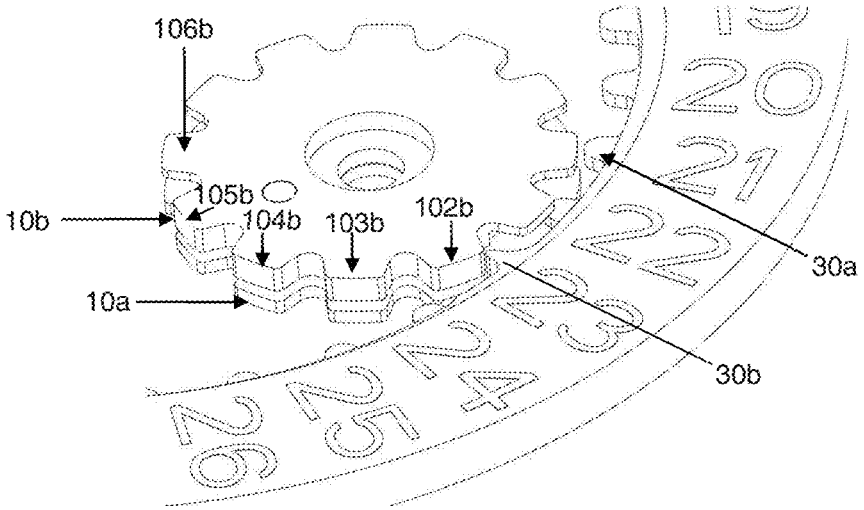
Figure 16:
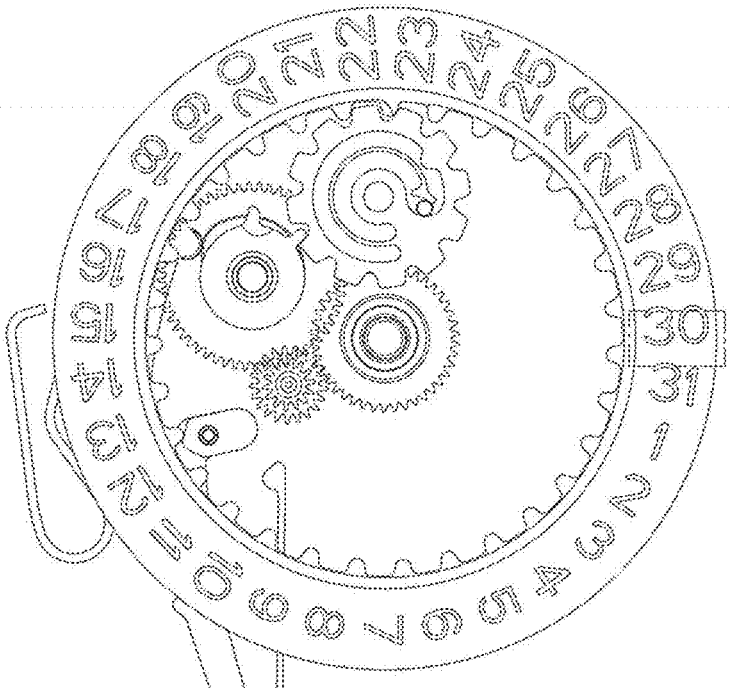
Figure 17:
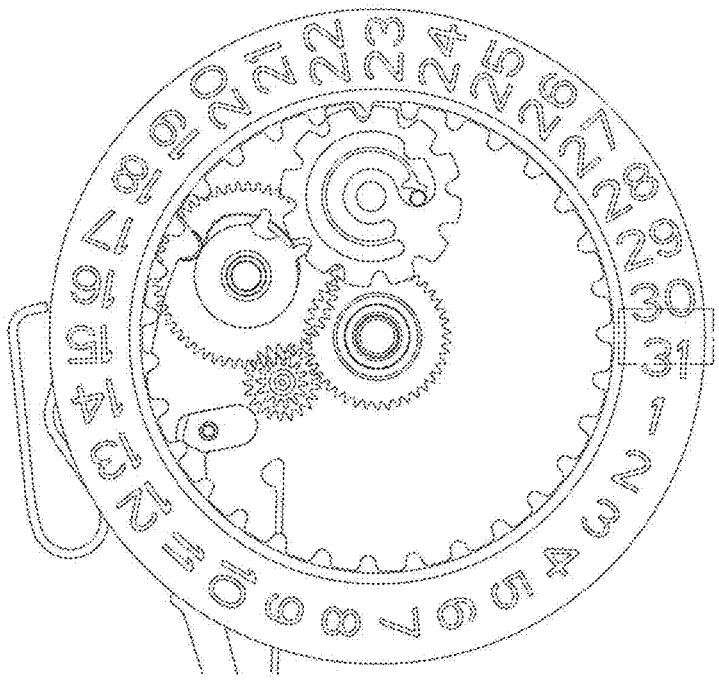
Figure 18:
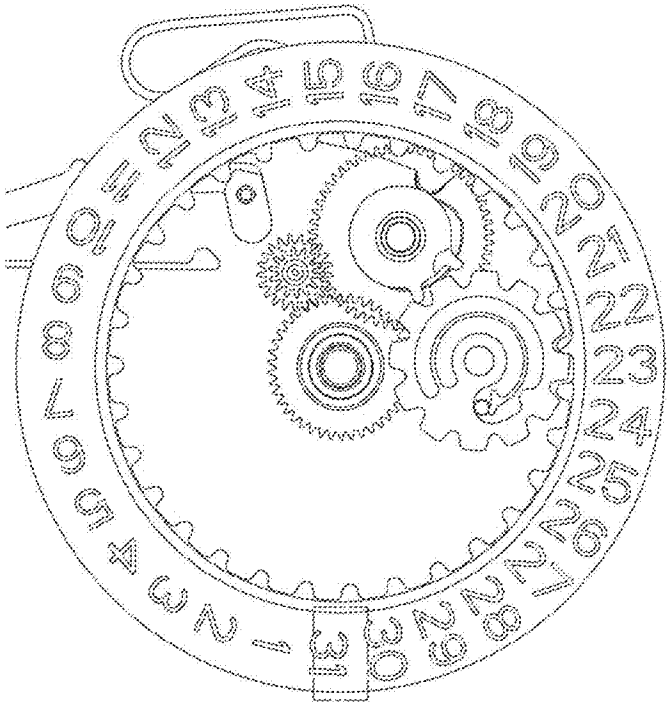

There follows a description hereafter of a date jump at the end of a 30-day month, for example at the end of the month of September. FIG. 14 illustrates the annual calendar mechanism on September 30, just before the date jump from September 30 to October 1. In this configuration, the mobile 1 is positioned such that a tooth 102*c* of the wheel 1*b* is capable of actuating the tooth 30*b* of the date disk. To do this, a single conformation 102*b*, 102*c* allows the interaction with the fourth set of teeth and with the tooth 30*b* of the fifth set of teeth as represented in FIG. 15. The actuation of the tooth 30*b* induces the displacement of the date disk 3 over a first angular pitch of the date disk as represented in FIGS. 16 to 18. The displacement of the date disk results also in the rotation of the wheel 1*a* through the first 10*a* and fourth 30*a* sets of teeth which are continually engaged. Thus, the wheels 1*a* and 1*b* pivot in a synchronized manner on a first jump of the date disk to switch from the 30th to the "31st" of a short month, such that the mobile 1 rotates by a first angular pitch.

FIGS. 16 to 18 represent the finger 20*b* of the driving mobile 2 in the course of actuation of the set of teeth 10*b* of the wheel 1*b* to allow for the first jump of the date disk, from the 30th to the "31st".

Figure 19:
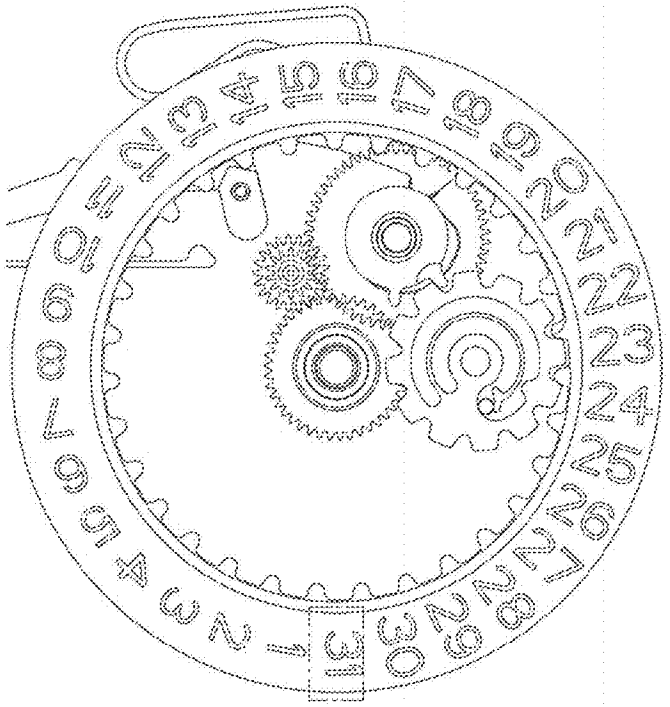
Figure 20:
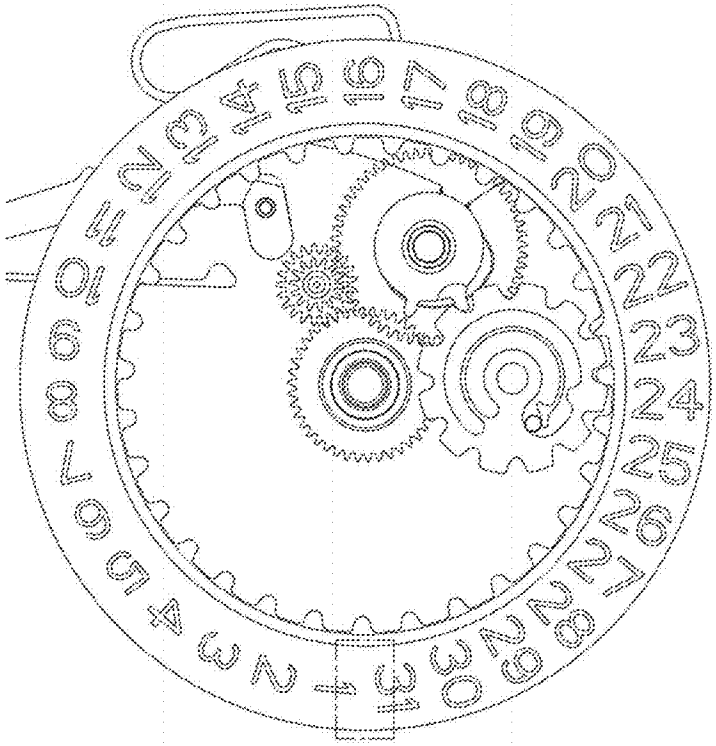
Figure 21:
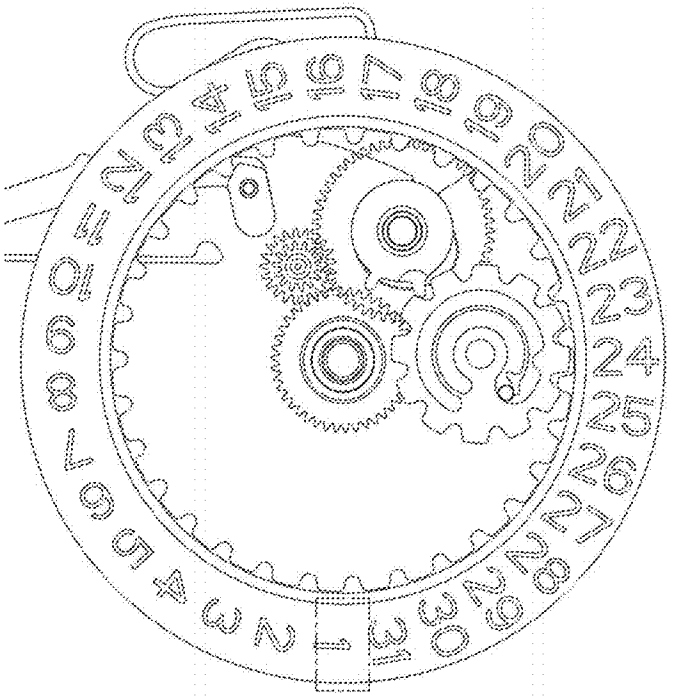

FIGS. 19 to 21 represent the finger 20*a* of the driving mobile 2 in the course of actuation of the set of teeth 10*a* of the wheel 1*a* to allow for the second jump of the date disk, from the "31st" to the 1st of the next month.

Figure 22:
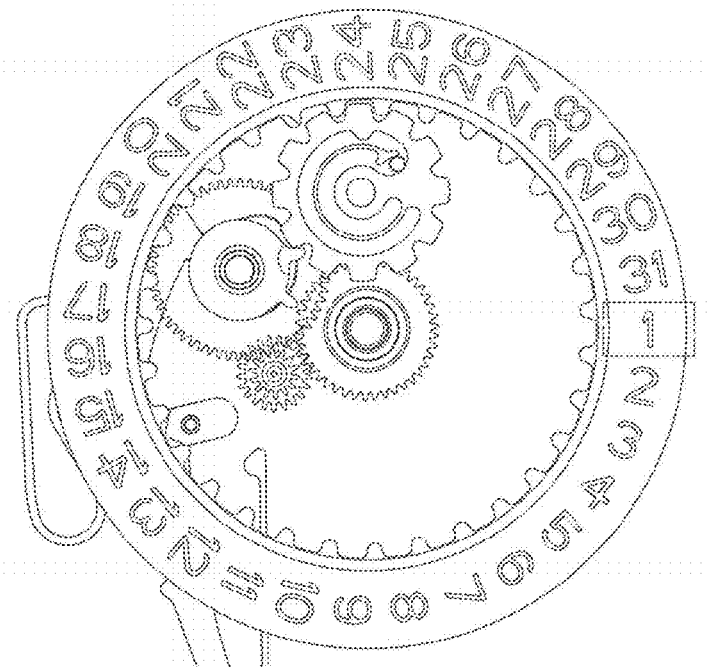

FIG. 22 illustrates the mechanism once the double date jump has been performed. As seen previously, the finger 20*a*, held in position under the effect of immobilization of the cam 6, is situated in the set of teeth 10*a* so as to avoid any risk of additional jump of the date disk.

The angular displacement of the date disk is a function of the angular displacement of the mobile 1, namely of the angular displacement of the wheels 1*a* and 1*b* relative to the frame of the movement. If a conventional date jump is produced by the rotation by one angular pitch of the wheel 1*a*, which also involves the rotation by an angular pitch of the wheel 1*b*, a double date jump at the end of a short month involves the rotation of the mobile 1, namely the rotation of the wheels 1*a* and 1*b* over two angular pitches of the mobile 1.

Figure 23:
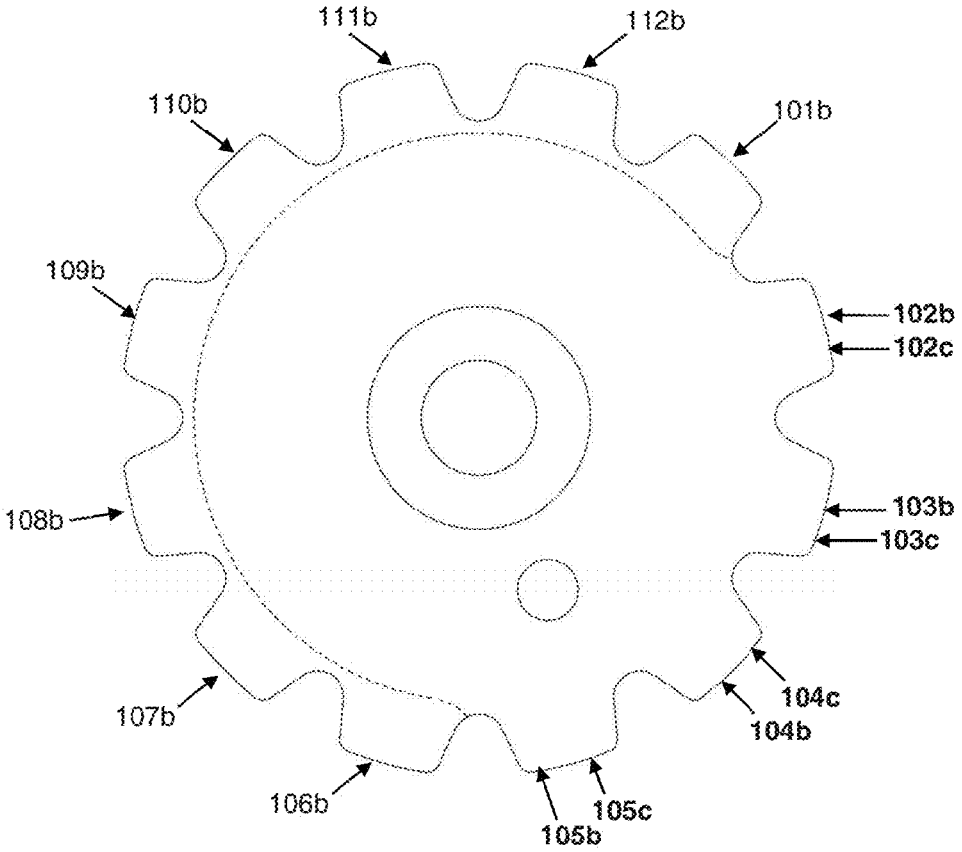

Over a full year, the mobile 1, the wheels 1*a* and 1*b* of which are provided with twelve teeth each, therefore perform thirty-one revolutions. Studies of the applicant have shown that it was possible to arrange teeth within the set of teeth 10*c* which are configured to actuate the tooth 30*b* of the disk 3 only on the 30th of a short month. There are four of these teeth for the wheels 1*a* and 1*b* of twelve teeth, and each is dedicated to a particular month without considering the month of February, as represented in FIGS. 15 and 23. These teeth 102*c*, 103*c*, 104*c*, 105*c* are disposed side by side, and constitute a toothed segment of the set of teeth 10*c*. As seen previously, in the particular construction, the conformations 102*b*, 102*c* and 103*b*, 103*c* and 104*b*, 104*c* and 105*b*, 105*c* are thicker than the conformations 101*b* and 106*b* to 112*b* forming the teeth of the second set of teeth. Thus, the conformations 102*b*, 102*c* and 103*b*, 103*c* and 104*b*, 104*c* and 105*b*, 105*c* can interact with the tooth 30*b*. Alternatively, the teeth of the third set of teeth could have a different geometry to that of the teeth of the second set of teeth. For example, the third set of teeth could have a head diameter different to that of the second set of teeth. The fifth set of teeth could also have a head diameter different to that of the fourth set of teeth.

The table of FIG. 24 illustrates the cycle of the rotations of the wheel 1*b* over a year, and highlights the teeth of the second and third sets of teeth that present themselves facing the tooth 30*b* of the date disk every 30th of the month. The columns J, F, M, A, M, J, J, A, S, O, N, D respectively represent the twelve months (M) of the year in chronological order. For their part, the rows indicate the dates (Q) of the month (M) of the year.

We note that:

the teeth 102*b* and 102*c* present themselves facing the tooth 30*b* at the end of the month of September, the teeth 103*b* and 103*c* present themselves facing the tooth 30*b* at the end of the month of April, the teeth 104*b* and 104*c* present themselves facing the tooth 30*b* at the end of the month of November, the teeth 105*b* and 105*c* present themselves facing the tooth 30*b* at the end of the month of June, the teeth 106*b* to 112*b* are each situated facing the tooth 30*b* at the end of a 31-day month. The latter cannot interact with the tooth 30*b*.

The studies of the applicant have shown that the principle is valid for any mobile 1 with wheels 1*a*, 1*b* that are provided with N teeth, where N is a multiple of 12. The set of teeth 1*c* is then provided with n teeth configured to actuate the tooth 30*b*, which are distributed in N/12 segment on the mobile 1, where N is a multiple of four with N/n=3.

Obviously, the month of February can be considered as a short month which is made up of 30 days, even if an adjustment will have to be made. In this case, the wheel 1*b* can then be provided with n' teeth with n'=n+N/12.

In the embodiment previously described, the wheels 1*a* and 1*b* are provided with external sets of teeth 10*a*, 10*b*, 10*c* which are provided to cooperate with internal sets of teeth 30*a*, 30*b* of the date indicator 3. Alternatively, the sets of teeth 30*a*, 30*b* of the date disk 3 can take the form of external sets of teeth. Alternatively, the wheels 1*a* and 1*b* can be provided with internal sets of teeth 10*a*, 10*b*, 10*c* which can for example cooperate with external sets of teeth 30*a*, 30*b* of the date indicator 3, in particular for N=24 or N=36. In these alternative constructions, the mobile 3 can for example take the form of a disk or of a wheel to which is added a hand for displaying the date indication. Alternatively, the programming mobile 1 and/or the mobile 3 can be provided to actuate a mechanism for displaying a "large date".

In the embodiment previously described, the profiles of the sets of teeth 10*a*, 10*b* and 10*c* are identical. Alternatively, the profiles can of course differ so as to be optimized with regard respectively to the elements 20*a*, 30*a* and 20*b*, 30*b* with which they cooperate.

In the embodiment previously described, the angular indexing element 9 is provided to cooperate with the set of teeth 30*a* of the date disk 3. Alternatively, this indexing element can be provided to cooperate with the wheel 1*a*. Such a conformation can be advantageous for a wheel 1*a* provided with an internal set of teeth 10*a*.

A display of the month can for example be implemented by a device comprising a month display disk linked kinematically to the date indicator. Thus, it is possible to implement a particularly simple embodiment of an annual calendar. The month display device can be as described in the patent applications EP2428856 and EP2624075.

The driving device according to the invention is particularly simple, like the device disclosed in the application EP1596261. The driving device according to the invention implements a reduced number of parts, and relies on just a single kinematic chain driving the date disk.

The driving device according to the invention also offers the advantage of being particularly compact, and of implementing a particularly simple date disk structure.

Preferably, in this document, in "programming mobile", the term "mobile" means "an organ" or "a set of parts" or "a mechanism" that is movable or capable of moving, i.e. the parts of the set or of the mobile are advantageously mobile regarding one another and regarding other parts of the device. Preferably, in this document, in "programming mobile", the term "mobile" does not mean a single wheel, plate or disk.

Preferably, the date mobile 3 is constituted by a single part.

Preferably, the driving mobile 2 is constituted by a single part.

The invention claimed is:

1. A device for driving a date mobile of a horological calendar mechanism, the device comprising:

a driving mobile including a first finger and a second finger;

a programming mobile including a first set of teeth, a second set of teeth and a third set of teeth; and the date mobile including a fourth set of teeth and a fifth set of teeth, the first finger cooperating with the first set of teeth, the second finger cooperating with the second set of teeth, the first set of teeth cooperating with the fourth set of teeth and the third set of teeth cooperating with the fifth set of teeth.

2. The device as claimed in claim 1, wherein the programming mobile comprises a first wheel and a second wheel, the first set of teeth being located on the first wheel and the second and third sets of teeth being located on the second wheel.

3. The device as claimed in claim 2, wherein the first and second wheels can be displaced relative to one another, and wherein the programming mobile comprises a return element returning the first and second wheels to a first predefined relative position.

4. The device as claimed in claim 3, wherein the first and second wheels can be rotationally displaced relative to one another.

5. The device as claimed in claim 2, wherein the programming mobile comprises a first abutment and a second abutment, the first and second abutments being located respectively on the first and second wheels or being located respectively on the second and first wheels.

6. The device as claimed in claim 5, wherein the first abutment is a wall of an opening, and the second abutment is a pin.

7. The device as claimed in claim 2, wherein the programming mobile comprises a third abutment and a fourth abutment, the third and fourth abutments being located respectively on the first and second wheels or being located respectively on the second and first wheels.

8. The device as claimed in claim 7, wherein the third abutment is a wall of an opening formed on one or the other of the first and second wheels, and the fourth abutment is a surface of the return element.

9. The device as claimed in claim 2, wherein the first and second wheels are arranged so as to be able to be displaced relative to one another by a value of the order of the angular pitch of the first and second wheels.

10. The device as claimed in claim 2, wherein the device comprises a jumper cooperating with the fourth set of teeth or with the first set of teeth.

11. The device as claimed in claim 10, wherein the jumper and the return element are arranged so that a resisting torque opposing the rotation of the first wheel and exerted by the jumper is greater than a resisting torque opposing the rotation of the second wheel and exerted by the return element.

12. The device as claimed in claim 1, wherein at least one of (i) the first set of teeth has a number of teeth which is a multiple of twelve, (ii) the second set of teeth has a number of teeth which is a multiple of twelve, (iii) the third set of teeth has a number of teeth which is a multiple of four, and (iv) the fourth set of teeth has thirty-one teeth and/or wherein the fifth set of teeth has one tooth.

13. The device as claimed in claim 1, wherein at least one of (i) the first set of teeth has twelve teeth, (ii) the second set of teeth has twelve teeth, (iii) the third set of teeth has four teeth, the teeth of the third set of teeth having an angular pitch of 30° and being juxtaposed at the level of four consecutive 30° angular segments, (iv) the fourth set of teeth has thirty-one teeth, and (v) the fifth set of teeth has one tooth.

14. The device as claimed in claim 1, wherein at least one of (i) the first finger, the first set of teeth and the fourth set of teeth are disposed on a first level, and (ii) the second finger and the second set of teeth are disposed on a second level, and (ii) the third set of teeth and the fifth set of teeth are disposed on a third level.

15. The device as claimed in claim 1, wherein teeth of the second set of teeth and teeth of the third set of teeth are formed by common surfaces of the second wheel.

16. A calendar mechanism comprising a device as claimed in claim 1.

17. The mechanism as claimed in claim 16, which is of the instantaneous jump type.

18. A horological movement comprising a device as claimed in claim 1.

19. A timepiece comprising a device as claimed in claim 1.

20. The device as claimed in claim 1, which drives a date disk of a horological calendar mechanism.

* * * * *